US007320774B2

(12) United States Patent
Simmons et al.

(10) Patent No.: US 7,320,774 B2
(45) Date of Patent: Jan. 22, 2008

(54) METHOD FOR PROVIDING MULTIPLE TILE SHAPES OR APPEARANCES OF THE SAME

(75) Inventors: Troy Simmons, Laguna Niguel, CA (US); Bruce E. Lennick, Rancho Cucamonga, CA (US)

(73) Assignee: MonierLifetile, LLC, Irvine, CA (US)

( * ) Notice: Subject to any disclaimer, the term of this patent is extended or adjusted under 35 U.S.C. 154(b) by 0 days.

(21) Appl. No.: 10/656,893

(22) Filed: Sep. 4, 2003

(65) Prior Publication Data

US 2004/0123544 A1 Jul. 1, 2004

Related U.S. Application Data

(63) Continuation-in-part of application No. 10/347,663, filed on Jan. 21, 2003, now abandoned.

(60) Provisional application No. 60/441,336, filed on Jan. 21, 2003, provisional application No. 60/423,971, filed on Nov. 4, 2002.

(51) Int. Cl.

| | |
|---|---|
| ***B28B 11/08*** | (2006.01) |
| ***B28B 1/00*** | (2006.01) |
| *B28B 7/02* | (2006.01) |
| *B28B 7/14* | (2006.01) |

(52) U.S. Cl. ..... 264/333; 264/162; 52/519; 425/308

(58) Field of Classification Search ..... 264/157, 264/162, 163, 318, 333, 132, 133; 249/142, 249/155; 425/299, 308; 52/518, 519, 745.06
See application file for complete search history.

(56) References Cited

U.S. PATENT DOCUMENTS

| | | | | |
|---|---|---|---|---|
| 1,619,490 | A * | 3/1927 | Schwarz | 425/219 |
| 1,993,086 | A * | 3/1935 | Chaffee | 52/542 |
| 2,120,742 | A * | 6/1938 | Grundy | 52/98 |
| 3,349,534 | A * | 10/1967 | Wotherspoon | 52/520 |
| 4,092,092 | A * | 5/1978 | Dye et al. | 425/291 |
| 4,666,648 | A * | 5/1987 | Brittain | 264/145 |
| 4,695,418 | A * | 9/1987 | Baker et al. | 264/151 |
| 4,758,148 | A * | 7/1988 | Jidell | 425/219 |
| D347,483 | S | 5/1994 | Thomas | D25/139 |

(Continued)

FOREIGN PATENT DOCUMENTS

GB 2200930 A * 8/1988

*Primary Examiner*—Christina Johnson
*Assistant Examiner*—Matthew J. Daniels
(74) *Attorney, Agent, or Firm*—Alston & Bird LLP

(57) ABSTRACT

According to various embodiments, methods, apparatuses, and products are provided that use an S-shaped die mold and a scoring/knifing process to produce two types of dies (S-shaped tiles and C-shaped tiles) from the S-shaped tile mold. The scoring/knifing process forms one or more channels or other suitable shapes in the S-shaped tile. At least one of the channels creates the appearance that the S-shaped tile comprises two separate and cooperating tile sections, each having a generally C-shaped cross section. In a further embodiment, at least one of the channels may be painted, colored, or otherwise darkened to accent a "shadow" effect, further creating the appearance that the C-shaped portions of the S-shaped tile are separate. In another embodiment, a method is provided that allows the S-shaped tiles to be broken or not broken along one or more of the channels, depending on the installer's preference.

17 Claims, 5 Drawing Sheets

U.S. PATENT DOCUMENTS

| | | | | |
|---|---|---|---|---|
| D348,317 | S | 6/1994 | Thomas et al. | D25/139 |
| 5,326,318 | A * | 7/1994 | Rotter | 454/365 |
| 5,613,337 | A * | 3/1997 | Plath et al. | 52/533 |
| 5,651,226 | A * | 7/1997 | Archibald | 52/518 |
| 5,711,126 | A * | 1/1998 | Wells | 52/519 |
| 5,743,059 | A * | 4/1998 | Fifield | 52/519 |
| D411,316 | S | 6/1999 | Alvarez et al. | D25/140 |
| 5,974,757 | A | 11/1999 | Whitney et al. | 52/586.1 |
| 6,247,284 | B1 | 6/2001 | Alvarez et al. | 52/553 |
| D452,920 | S | 1/2002 | Alvarez et al. | D25/140 |
| RE38,210 | E * | 8/2003 | Plath et al. | 52/533 |
| 2004/0123544 | A1 * | 7/2004 | Simmons et al. | 52/519 |
| 2004/0237442 | A1 * | 12/2004 | Simmons | 52/518 |

* cited by examiner (UNDERSIDE)

METHOD FOR PROVIDING MULTIPLE TILE SHAPES OR APPEARANCES OF THE SAME

CROSS-REFERENCE TO RELATED APPLICATIONS

The present application claims the benefit and priority of pending U.S. provisional patent application Ser. No. 60/441,336 filed Jan. 21, 2003, entitled "Single Tile Having Two Piece Appearance". The present application also claims the fill benefit and priority of pending U.S. provisional patent application Ser. No. 60/423,971, filed Nov. 4, 2002, entitled "Method And Apparatus For Providing Multiple Tile Shapes From A Single Tile". The present application claims the benefit and priority and is a continuation-in-part (CIP) of U.S. Non-Provisional patent application Ser. No. 10/347,663 filed Jan. 21, 2003 now abandoned entitled "Single Tile Having Two Piece Appearance". The entire contents of the aforementioned two provisional patent applications and one non-provisional patent application are incorporated by reference.

BACKGROUND OF THE INVENTION

Various methods have been employed for making concrete tiles, such as concrete roof tiles. The particular methods used depend on such things as the shape of the tiles being formed. Typically, wet concrete is dispensed onto a moving pallet (a.k.a. "mold"), following which the pallet is passed under a roller and slipper to form and then shape the tile. A knife assembly chops and shapes the opposite edges of the tile. The wet concrete is cured and then removed from the pallet to provide the completed tile.

In a particular known method of making concrete roof tiles, a conveyor is used to transport the wet concrete from either a continuous mixer or a batch mixer to a making head assembly disposed above a conveyor containing a succession of moving pallets, arranged end-to-end. The pallets define the general shape of the tiles to be formed. As each pallet passes within the making head assembly, wet concrete is dispensed onto the pallet, with the help of a rotating roller which meters the concrete onto the pallet and compresses the wet concrete to a desired thickness. The pallet is then passed beneath a slipper which engages the wet concrete and has a profile selected to provide the concrete with a desired cross-sectional configuration. A knife assembly chops the continuous ribbon of concrete formed on the end-to-end succession of pallets to define the individual tiles and to shape the edges thereof. The pallets with the wet concrete extruded, compressed, shaped and chopped thereon are then separated and advanced to a racker, where the pallets are loaded onto racks for transport to a curing facility. The curing facility typically comprises an oven in which the tiles are heated at a desired temperature and for a desired period of time to cure the concrete. Following that, each concrete tile is removed from its supporting pallet to thereby provide the completed concrete tiles.

BRIEF SUMMARY OF THE INVENTION

Generally described, one embodiment of the invention includes the use of an S-Tile mold, including or combined with a scoring, knifing, shaping, or other type of process, which allows for subsequent controlled separation of what would normally be an S-Tile into two separate tile sections having a general C-shaped cross section. This allows for two types of tiles (S-tiles and Two-Piece Mission tiles) to be made from one type of mold (S-tile).

Another embodiment of the invention includes the use of an S-Tile mold, including or combined with a scoring, knifing, shaping, coloring, or other type of process, which allows for an S-Tile to be produced which appears to be two separate tile sections having a general C-shaped cross section, but in fact is a one piece element.

Another configuration of the present invention includes the use of an S-Tile mold, combined with a scoring, knifing, shaping, coloring, or other type of process, which allows for an S-Tile to be produced which appears to be two separate tile sections having a general C-shaped cross section, but in fact is a one piece element. However, this one piece element may be split itself if the need arises.

Therefore it is an object of the present invention to provide an improved method and apparatus for providing roof tiles.

It is a further object of the present invention to provide an improved roof tile and system for using same.

Other objects, features, and advantages of the present invention will become apparent upon reading the following detailed description of the preferred embodiment of the invention when taken in conjunction with the drawing and the appended claims.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 is a pictorial view of a "modified" S-tile 5, which includes sections 6 and 7. Also provided is a rectangular-type channel 9. This channel may be used as a breakage channel (to separate sections 6 and 7), or to simulate a dual-tile configuration (appearing to be two separate tiles). Exemplary nail holes NH1 and NH2 are also shown. This figure also shows optional items NH3 and score line (or channel) 99.

FIG. 2 is an end view of the tile of FIG. 1. Exemplary support ribs, barely shown in FIG. 1, are better shown as 6R and 7R in this figure. In this preferred embodiment, two substantially parallel ribs are used as a pair, with one each of each pair shown in FIG. 2. These ribs are also shown in FIG. 6; note a pair is used at one end and a single rib is used at the other end.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

General Description

Generally described, the invention includes several different embodiments or concepts. These embodiments could be thought of as including the following three general categories:

- S-Tile molding including separation "treatment" and breakage
- S-Tile molding including separation "treatment" and no breakage
- S-Tile molding including separation "treatment" and breakage or no breakage, as needed.

The term separation "treatment" is used to describe scoring, knifing, shaping, coloring, or another type of process, which allows for an S-Tile (a.k.a. "Espana") to be produced which appears to be two separate tile sections having a general C-shaped cross section (a.k.a. "Mission") and/or which can actually be separated or "broken" into two tile sections.

Category One

General

This category includes the use of a conventional S-Tile mold, combined with a scoring/knifing or other type of process, which allows for subsequent controlled separation of what would normally be an S-Tile into two separate tile sections having a general C-shaped cross section (a.k.a. Two-Piece Mission Tiles). This allows for two types of tiles (S-tiles and Two-Piece Mission tiles) to be made from one type of mold (S-tile).

More Details

Figure 1:
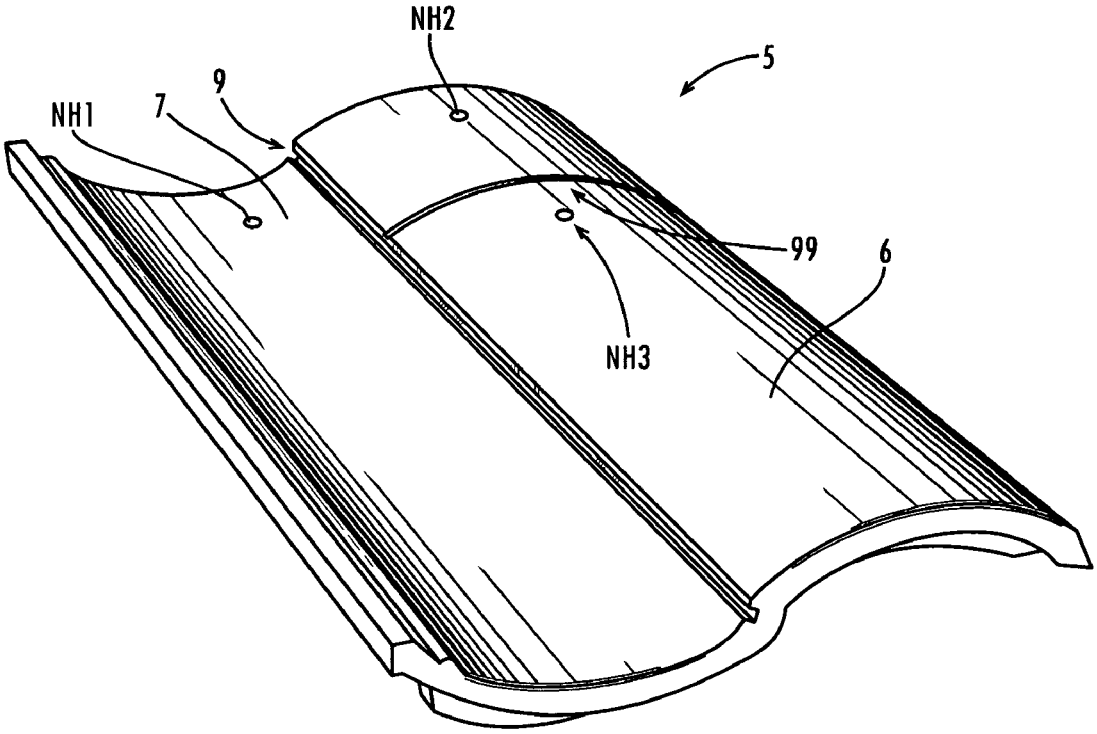

Reference is first made to FIG. 1, which is a pictorial view of a "modified" S-tile 5, which includes sections 6 and 7. Also provided is a separation channel 9. It should be understood that under one embodiment of the invention, this tile shape would not be installed as a whole on a roofing structure, but would be broken as noted below. However, under another embodiment this tile shape could be so installed as a whole. As described elsewhere, after curing, the tile 5 is intended to be broken along channel 9 so that two Two-Piece Mission tile shapes are provided, corresponding to sections 6 and 7.

Figure 2:
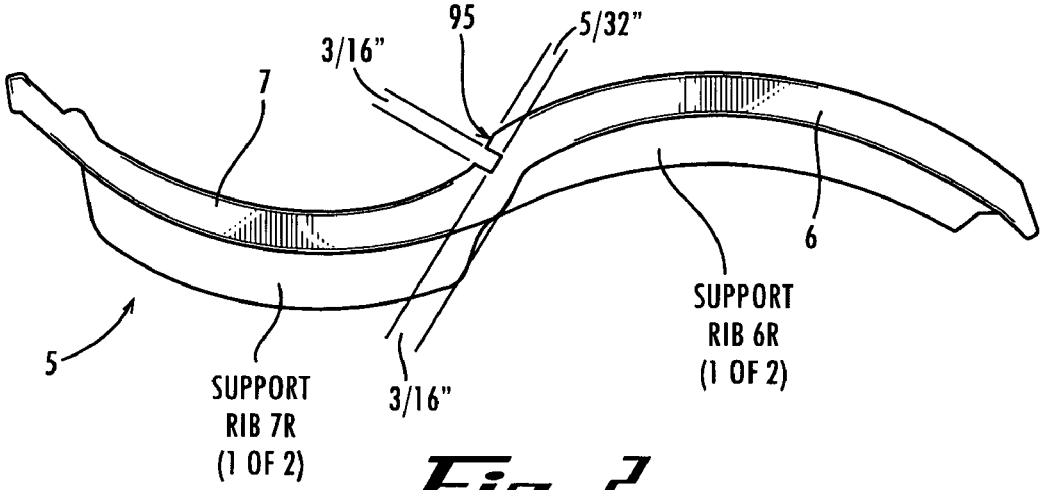

Referring now also to FIG. 2, which is an end view of the tile of FIG. 1, the channel 9 is 3/16 inch wide, and 5/32 deep, although other configurations are contemplated without departing from the spirit and scope of the present invention. In an alternate configuration, a knife edge could be used instead of the formed channel.

It should be understood that under one embodiment of the invention, a "shading" treatment could be applied, which involves the use of a small jet to squirt suitable ink onto the score line, as shown generally on the surface 9S in FIG. 2. It should be understood that this "shading" treatment could be applied to any of the embodiments of the invention as needed.

It should be understood that a "conventional" S-tile is such as shown in FIGS. 1 and 2, but without the channel 9 (or knife cut 99).

Manufacturing

The overall manufacturing process is as follows. Conventional S-type tiles can be made as needed in a conventional S-tile mold (not shown), with occasionally the modified S-tiles 5 being made. In one example, out of 40,000 tiles being made, the last 10-15% could be modified S-tiles. However, other manufacturing ratios may also be provided without departing from the spirit and scope of the present invention, and may be easily varied as needed to accommodate demand.

The conventional S-tiles will be manually or automatically de-palleted from the mold as is presently done in the art.

Figure 3A:
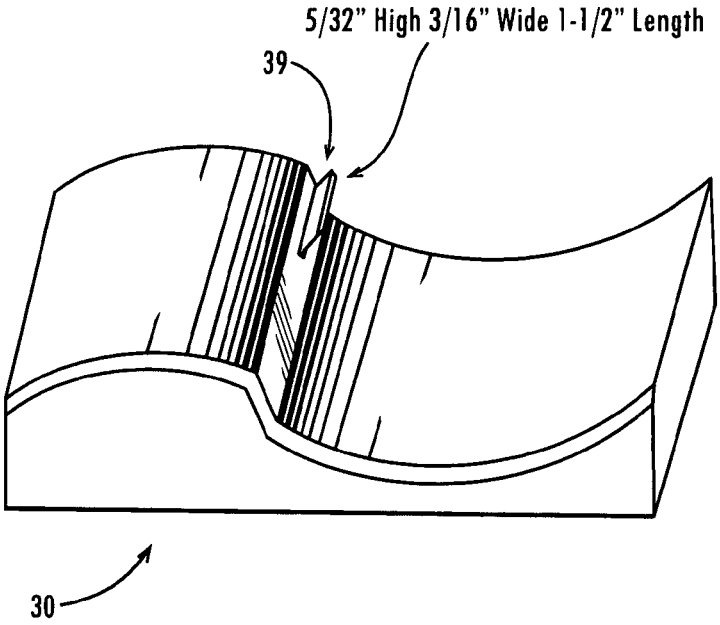
FIG. 3A is a pictorial view of a modified slipper design 30 configured for use with the invention.
Figure 3B:
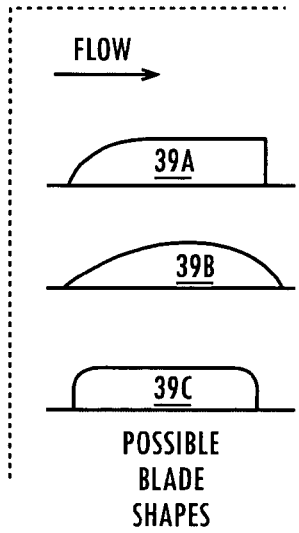
FIG. 3B are illustrative views of possible blade shapes.

In order to "switch over" to Two-Piece Mission type tiles, under one version of the invention, the line is stopped and the slipper configuration is changed. Reference is now made to FIG. 3A, which is a pictorial view of a modified slipper design 30, which includes a scoring blade 39, which is configured to form the channel 9 during the forming process. In one configuration the scoring blade is 5/32 inches high, 3/16 inches wide, and 1.5 inches in length, although other configurations are contemplated without departing from the spirit and scope of the present invention. FIG. 3B shows various possible scoring blade configurations 39A, 39B, 39C.

As noted above, under the first embodiment of the invention, in order to use the slipper configuration in FIG. 3, the line has to be stopped and the slippers exchanged. However, an alternative invention includes the concept of configuring the slipper to allow the blade 39 to be moved up and down such that it scores as desired in one position, but presents a flat surface flush with the slipper in a second position. Another alternative configuration includes not modifying the slipper at all but simply lowering a tool into place downstream of the slipper; this could be done while the line is going.

The tile 5 will be allowed to cure as all other tiles. It will then be hand de-palleted from the mold, broken along the score line and packaged as two separate pieces.

Installation

Figure 4:
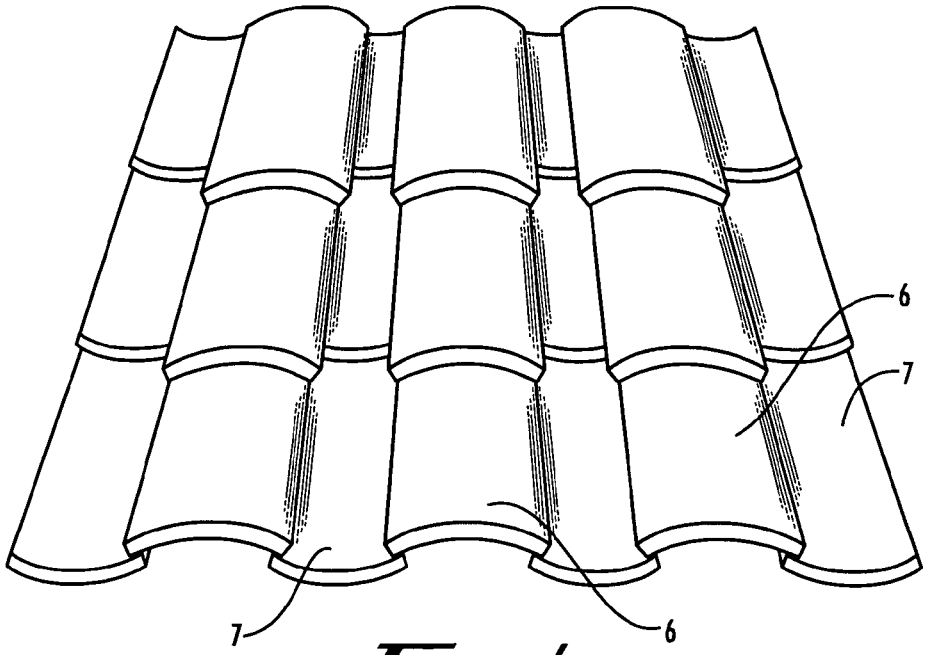
FIG. 4 is a pictorial view of a plurality of Two-Piece Mission tiles.

The smaller tiles 6 and 7 can be installed such as shown in FIG. 4, which shows a plurality of Two-Piece Mission tiles installed on a demonstration surface.

Category Two

General Description

Generally described, this embodiment invention includes the use of an S-Tile mold, combined with a scoring, knifing, and/or coloring process, which allows for an S-Tile to appear as two separate tile sections having a general C-shaped cross section, by use of a "simulation interface channel" 9. These tile sections having a general C-shaped cross section may also be known as "mission tiles".

More Detailed Discussion

Figure 5:
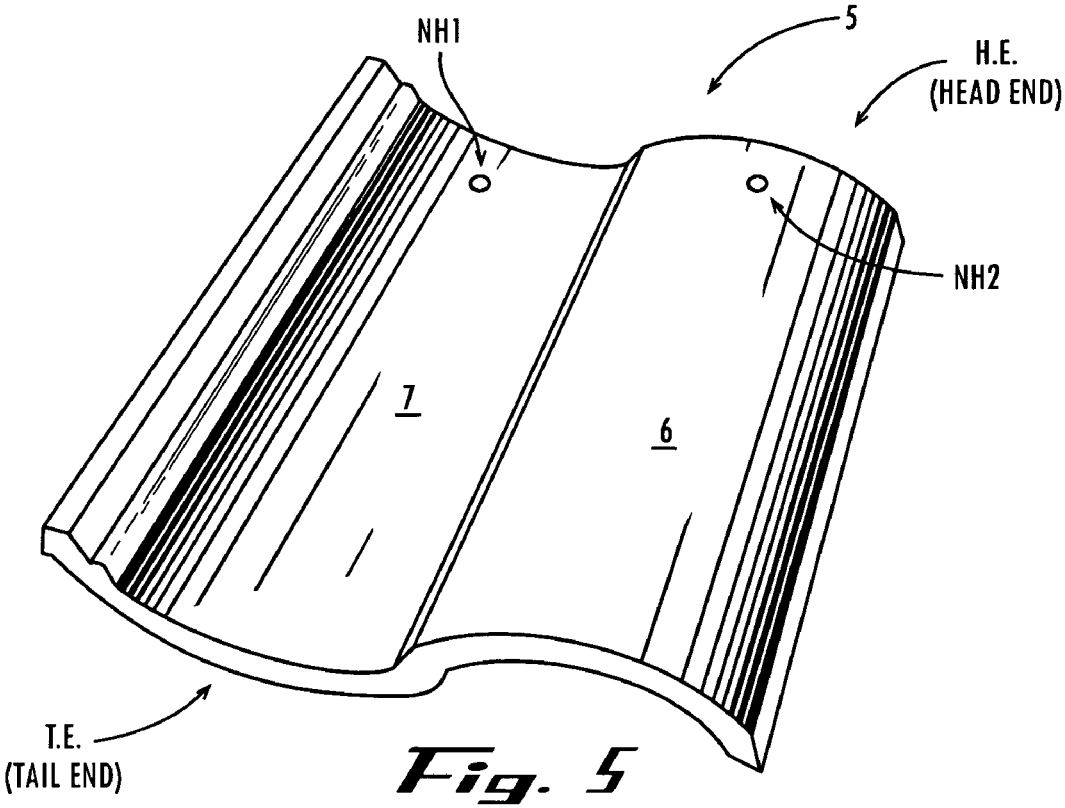
FIG. 5 is a tile 5 according to one embodiment of the present invention, showing nail holes NH1 and NH2, and showing a Head End "H.E." and a Tail End "T.E.".

Reference is first made to FIG. 5, which is a pictorial view of a "modified" S-tile 5, which includes portions 6 and 7, and defines a head end HE and a tail end TE. Also provided is a channel 9. It should be understood that under one embodiment of the invention this tile shape is intended for installation as a whole on a roofing structure, simulating two cooperating mission tile shapes.

Figure 6:
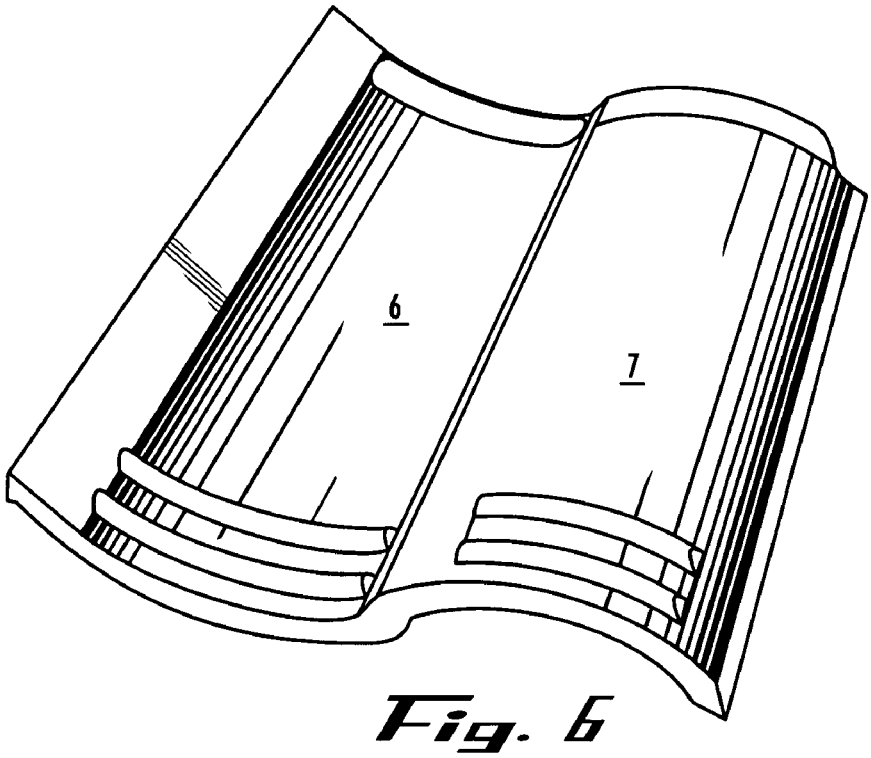
FIG. 6 is the underside of that shown in FIG. 5.

FIG. 6 is the underside of that shown in FIG. 5.

Figure 7:
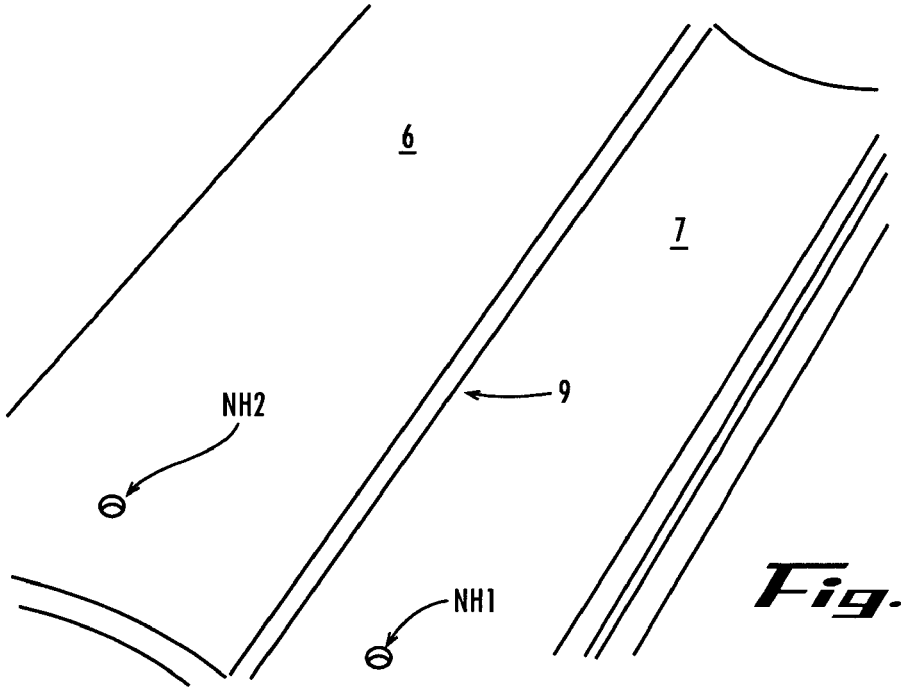
FIG. 7 is a more detailed view of the tile 5 of FIG. 5, showing in more detail the location of channel 9.

FIG. 7 is a more detailed view of the tile 5 of FIG. 5, showing in more detail the channel 9.

Figure 8:
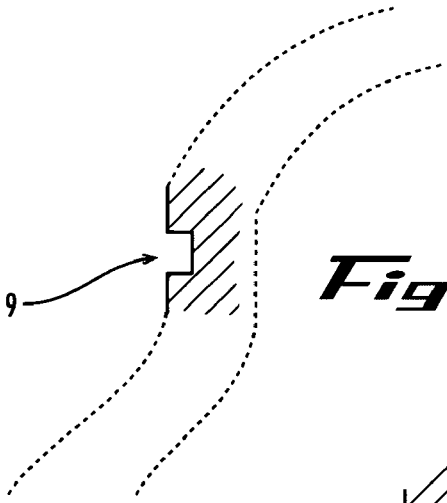
FIG. 8 is an illustrative drawing of the channel shown in FIG. 7. Partial cross hatching is shown.

Referring now also to FIG. 8, the channel can be 3/16 inch wide, and 5/32 deep, although other configurations are contemplated without departing from the spirit and scope of the present invention, especially if such other configurations are found more structurally and/or aesthetically effective or desirable. This simulation interface channel 9 simulates the interface of two separate tiles corresponding to portions 6 and 7. It should be understood that this channel may also be painted, colored, or otherwise darkened in order to accent a "shadow" effect which causes the eye to better perceive separation of the two portions 6 and 7.

Manufacturing Considerations

The overall manufacturing process can be as follows. Conventional S-type tiles can be made as needed in a conventional S-tile mold (not shown), with occasionally the modified S-tiles 5 being made. In one example, out of 40,000 tiles being made, the last 10-15% could be modified S-tiles. However, other manufacturing ratios may also be provided without departing from the spirit and scope of the present invention, and may be easily varied as needed to accommodate demand.

The conventional S-tiles will be manually or automatically de-palleted from the mold as is presently done in the art.

In order to "switch over" to Simulated Two-Piece Mission type tiles, under one version of the invention, the line is stopped and the slipper configuration is changed. Reference is now made to FIG. 3A, which is a pictorial view of a modified slipper design 30, which includes a scoring blade 39, which is configured to form the channel 9 during the forming process. In one configuration the scoring blade is {fraction 5/32)} inches high, {fraction (3/16)} inches wide, and 1.5 inches in length, although other configurations are contemplated without departing from the spirit and scope of the present invention.

As noted above, under the first embodiment of the invention, in order to use the slipper configuration in FIG. 3A, the line has to be stopped and the slippers exchanged. However, an alternative invention includes the concept of configuring the slipper to allow the blade 39 to be moved up and down such that it scores as desired in one position, but presents a flat surface flush with the slipper in a second position. Another alternative configuration includes not modifying the slipper at all but simply lowering a tool into place downstream of the slipper; this could be done while the line is going.

Curing and Installation

The tile 5 will be allowed to cure as all other tiles, and can be installed in the same manner as a conventional S-tile. However, should the need arise, the channel could be used as a break line should the installer need a half tile width at the end of a course of tiles.

Alternatives

Figure 9:
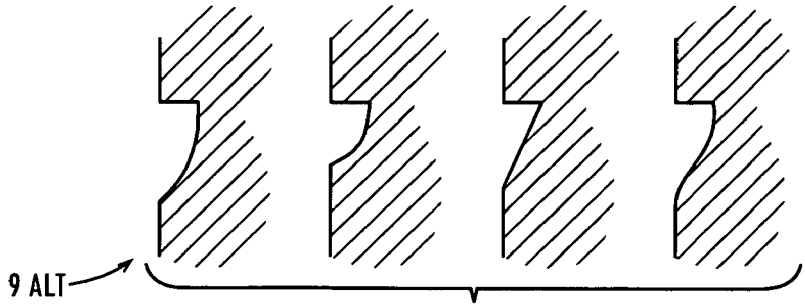
FIG. 9 is an illustrative drawing of alternate channels 9ALT. Partial cross hatching is shown.
Figure 10:
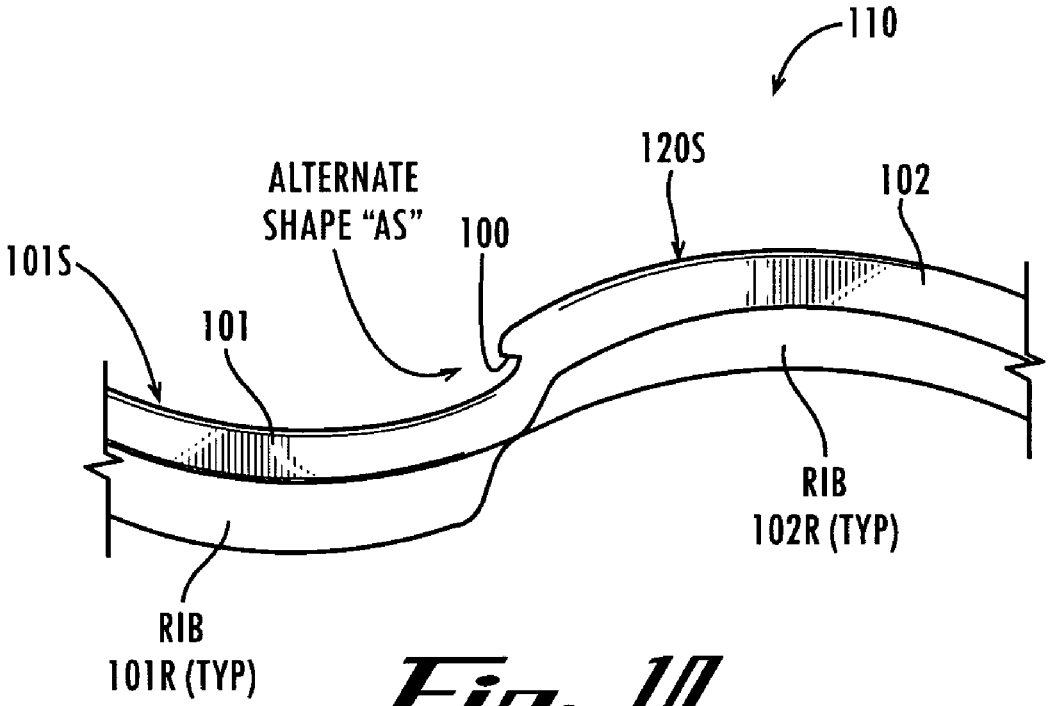
FIG. 10 is a partial tail (a.k.a., "butt") end view of an alternate tile 110 having an alternate shape of an interface. As may be seen an overhang is provided which defines a single substantially flat shelf portion 1000.

There are many alternative channel configurations which may be used. The rectangular channel may be used as shown in FIG. 8, or alternative channel shapes such as shown in FIG. 9 or 10 may be used. Knife cuts could also be used.

Category Three

The present invention also contemplates the use of tiles such as described above which can be used as either a "breaking" tile or a non-breaking tile, purely at the decision of the installer.

Variations

Under another variation, a portion of the cap part of the S tile is installed on top of a cap on a regular S tile, which could be considered a "boosted" tile. This gives the appearance of an "old world" installation. Reference is made back to FIG. 1. Under this version, the same channel 9 as before is provided. However there is also applied a second channel or knife cut 99 to the cap portion of the S tile perpendicular to the length of the tile and about 3½" from the top of the tile, although other lengths may be provided without departing from the sprit and scope of the present invention. This knife cut is provided by a transverse knife edge coming down from above at a suitable location. An additional nail hole NH3 is also applied in the cap portion of the tile approximately 4" from the top (although this could also be varied). The knife cut only cuts about halfway through the concrete and acts like a perforation. When the tile is de-palleted and loaded on the roof, the roofer breaks the tile down the middle using the first score line (or channel). Then he breaks the top off using the perforation/score line of the second knife cut. The remaining piece (the one with the nail hole NH3) can then be installed on top of the cap of an installed S tile with mortar to give it an "old" look. The additional nail hole NH3 is for a wire clip to provide a mechanical attachment, as well as the mortar.

In this alternate configuration as may be seen there will be three tile members provided after the double breaking process; a long pan piece, a medium length cap piece, and a short cap piece. The long pan piece may be used as a course starter, and the shortest piece may be used either as a double boost element (stacking even higher on top of the medium length piece) or as needed in a hip stack environment.

It should be understood that other tile profiles could be used without departing from the spirit and scope of the present invention. For example, other types of back-supporting ribs could be used. Knife cuts could be used to provide channels such as 9.

It should also be understood that etching or any type of chemical/fluid treatment could be used to provide the breakage line (a.k.a. "breakage treatment"). However, this would need to be done after the tile has cured.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of providing multiple tile shapes from one tile mold, the method comprising the steps of:

providing a first tile shape without a simulation interface channel by use of said tile mold and a first slipper, said first tile shape being a single, generally S-tile shape; and providing a second tile shape by use of said tile mold and a second slipper, said second tile shape being a single, generally S-tile shape, and defining a necked portion between a cap portion and a pan portion of the second tile shape, the necked portion having a thickness that is substantially equal to or less than a thickness of the cap portion and a thickness of the pan portion immediately adjacent the necked portion, wherein the necked portion defines a simulation interface channel that lies within a plane that is skewed relative to a vertical plane that includes the gravitational axis of the second tile shape while in said mold, wherein said second tile shape simulates two tiles that each have a generally "C"-shaped transverse cross section, and wherein the simulation interface channel is configured to facilitate breakage of the second tile shape between the cap portion and the pan portion.

2. A method of providing multiple tile shapes from one mold, the method comprising the steps of:

providing a first tile shape without a separation channel by use of said tile mold and a first slipper, said first tile shape being a single, generally S-tile shape;

providing a second tile shape by use of said tile mold and a second slipper, the second tile shape being a single, generally S-tile shape comprising a cap portion and a pan portion, and the second tile shape defining a separation channel that extends longitudinally between the cap portion and the pan portion along one or more surfaces of the second tile shape, wherein the separation channel further lies along a plane that is skewed relative to a vertical plane that includes the gravitational axis of the second tile shape while in said mold; and breaking said second tile shape along said separation channel, such that said second S-tile shape is converted into two generally Mission tile shapes, one being a "cap" type and one being a "pan" type, wherein said cap type defines a concave surface relative to a supporting surface when later installed and said pan types defines a convex surface relative to the supporting surface.

3. A method of providing a roof structure by use of a tile mold, the method comprising the steps of:

providing a first tile shape by use of said tile mold, said first tile shape having a single, generally "S"-shaped transverse cross section and including a cap portion and a pan portion, said cap portion defining a concave surface when later installed relative to a supporting surface and said pan portion defining a convex surface relative to said supporting surface;

providing a second tile shape by use of said tile mold, said second tile shape having a single, generally "S"-shaped transverse cross section and including a cap portion and a pan portion relative to the supporting surface, and wherein the second tile shape defines a necked portion between the pan portion and the cap portion, the necked portion having a thickness that is substantially the same as or less than a thickness of the cap portion and a thickness of the pan portion immediately adjacent the necked portion, the necked portion further defining a first breakage channel on one or more surfaces of the second tile shape, the first breakage channel lying within a plane that is skewed relative to a vertical plane that includes the gravitational axis of the second tile shape while in said mold and being configured to facilitate breakage of the second tile shape between the cap portion and the pan portion, and the cap portion defining a second breakage channel extending substantially normally to a longitudinal axis of the cap portion, the second breakage channel configured to facilitate breakage of the cap portion into two sections, wherein each of the two cap portion sections and the pan portion have a generally "C"-shaped transverse cross section;

breaking the second tile shape along the first breakage channel;

breaking the cap portion of the second tile shape along the second breakage channel;

installing said first tile shape atop the supporting surface; and attaching one or the two cap portion sections of said second tile shape atop the cap portion of said first tile shape.

4. A method according to claim 3 wherein said two cap portion sections comprise a first cap portion section and a second cap portion section, said first cap portion section being shorter than said second cap portion section, and wherein said step of attaching one of said cap portion sections atop said cap portion of said first tile shape includes attaching said first cap portion section atop said cap portion of said first tile shape.

5. A method of providing a plurality of tiles the method comprising the steps of:

providing a first tile shape by use of said tile mold, said first tile shape having a single, generally "S"-shaped transverse cross section and including a cap portion and a pan portion, said cap portion defining a concave surface relative to a supporting surface when later installed and said pan portion defining a convex surface relative to said supporting surface;

providing a second tile shape having a single, generally "S"-shaped transverse cross section comprising a cap portion and a pan portion, wherein:

the second tile shape defines a breakage channel on a surface of the second tile between the cap portion and the pan portion, the breakage channel lies within a plane that is skewed relative to a vertical plane that includes the gravitational axis of the second tile shape while in said mold and is configured to facilitate breakage of the second tile shape between the cap portion and the pan portion, and each of the cap portion and the pan section have a generally arcuate-shaped transverse cross section upon breaking; and breaking the second tile shape along the breakage channel.

6. The method of claim 5 further comprising the steps of:

installing the first tile shape atop the supporting surface; and installing the cap portion of the second tile shape vertically adjacent the cap portion of the first tile shape.

7. The method of claim 5 wherein the breakage channel is a first breakage channel and the cap portion defines a second breakage channel along a surface of the cap portion, the second breakage channel extending in a substantially normal direction to a longitudinal axis of the cap portion and being configured to facilitate breakage of the cap portion into two sections.

8. The method of claim 7 further comprising the step of packaging the cap portion of the second tile shape for shipment to a customer upon breaking the second tile shape along the first breakage channel.

9. The method of claim 7 wherein the two cap portion sections comprise a first cap portion section and a second cap portion section, said first cap portion section being shorter than said second cap portion section.

10. The method of claim 9 further comprising the steps of:

breaking the cap portion of the second tile shape along the second breakage channel;

installing said first tile shape atop the supporting surface; and attaching the first cap portion section vertically adjacent the cap portion of the first tile shape.

11. The method of claim 7 further comprising the steps of:

breaking the cap portion of the second tile shape along the second breakage channel;

installing said first tile shape atop the supporting surface;

attaching one of the two cap portion sections of said second tile shape atop the cap portion of the first tile shape.

12. The method of claim 5 wherein the second tile shape comprises a necked portion intermediate the pan portion and the cap portion, the necked portion having a thickness that is substantially the same as or less than a thickness of the cap portion and a thickness of the pan portion immediately adjacent the necked portion, the necked portion further defining the breakage channel.

13. The method of claim 5 wherein the second tile shape defines one or more breakage channels between the cap portion and pan portion on one or more surfaces of the second tile shape.

14. A method of providing a tile using a tile mold, the method comprising the steps of:

providing a tile shape by use of a tile mold, said tile shape having a single, generally "S"-shaped transverse cross section and comprising a cap portion and a pan portion, wherein:

said cap portion defines a concave surface relative to a supporting surface when later installed, said pan portion defines a convex surface relative to said supporting surface, and said tile shape defines at least one breakage channel on one or more surfaces of said tile shape, wherein the at least one breakage channel lies within a plane that is skewed relative to a vertical plane that includes the gravitational axis of the second tile shape while in said and is configured to facilitate breakage of the tile shape between the cap portion and the pan portion, and wherein each of the cap portion and the pan portion has a generally arcuate-shaped transverse cross section upon breaking;

breaking said tile shape along the at least one breakage channel; and packaging said cap portion of said tile shape for shipment to a customer.

15. The method of claim 14 wherein said cap portion defines a second breakage channel along one or more surfaces of said cap portion, said second breakage channel extending in a substantially normal direction to a longitudinal axis of said cap portion and being configured to facilitate breakage of said cap portion into two sections.

16. The method of claim 14 wherein the tile shape further comprises a necked portion extending between the cap portion and the pan portion, the at least one breakage channel being defined along the necked portion, wherein the necked portion has a thickness that is substantially the same as or less than a thickness of the cap portion and a thickness of the pan portion immediately adjacent the necked portion.

17. A method of providing a tile using a tile mold, the method comprising the steps of:

providing a tile shape by use of a tile mold, said tile shape having a single, generally "S"-shaped transverse cross section and comprising a cap portion and a pan portion, wherein:

said cap portion defines a concave surface relative to a supporting surface when later installed, said pan portion defines a convex surface relative to said supporting surface, and said tile shape defines at least one breakage channel on one or more surfaces of said tile shape, wherein at least a portion of the at least one breakage channel lies vertically below an overhang portion of said cap portion while in said mold, said overhang portion lying between said at least one breakage channel and an apex of said cap portion, and wherein said at least one breakage channel is configured to facilitate breakage of the tile shape between the cap portion and the pan portion, and wherein each of the cap portion and the pan portion has a generally arcuate-shaped transverse cross section upon breaking;

breaking said tile shape along the at least one breakage channel; and packaging said cap portion of said tile shape for shipment to a customer.

* * * * *

UNITED STATES PATENT AND TRADEMARK OFFICE

CERTIFICATE OF CORRECTION

PATENT NO. : 7,320,774 B2
APPLICATION NO. : 10/656893
DATED : January 22, 2008
INVENTOR(S) : Simmons et al.

It is certified that error appears in the above-identified patent and that said Letters Patent is hereby corrected as shown below:

Column 9,

Line 35, after "while in said" insert --mold--.

Signed and Sealed this

Twentieth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,320,774 B2
APPLICATION NO. : 10/656893
DATED : January 22, 2008
INVENTOR(S) : Simmons et al.

It is certified that error appears in the above-identified patent and that said Letters Patent is hereby corrected as shown below:

Column 9,

Line 35, after "while in said" insert --mold--.

Signed and Sealed this

Seventeenth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,320,774 B2
APPLICATION NO. : 10/656893
DATED : January 22, 2008
INVENTOR(S) : Troy Simmons and Bruce E. Lennick It is certified that error appears in the above-identified patent and that said Letters Patent is hereby corrected as shown below:

Please change the Assignee name on the title page (73) of the patent to read as follows:

Boral Lifetile, Inc., Roswell, GA (USA), and Monier, Inc., Irvine, CA (USA)

Signed and Sealed this

Twelfth Day of August, 2008

JON W. DUDAS
*Director of the United States Patent and Trademark Office*